United States Patent [19]

Merrill

[11] 4,027,990

[45] June 7, 1977

[54] ADJUSTABLE CURBER AND SIDEWALK-FORMING MACHINE

[76] Inventor: Charles T. Merrill, 760 S. Postville Drive, Lincoln, Ill. 62656

[22] Filed: Oct. 6, 1975

[21] Appl. No.: 619,921

Related U.S. Application Data

[63] Continuation-in-part of Ser. No. 480,844, June 19, 1974, abandoned.

[52] U.S. Cl. ..... 404/98; 404/105; 425/59; 425/63; 425/219; 425/456

[51] Int. Cl.[2] ..... B28B 13/04; E01C 19/48

[58] Field of Search ..... 425/63–65, 425/219, 432, 456, 59; 404/98, 105–106

[56] References Cited

UNITED STATES PATENTS

| | | | |
|---|---|---|---|
| 1,724,054 | 8/1929 | Troyer | 425/105 |
| 2,297,978 | 10/1942 | Oswald | 425/219 |
| 3,108,518 | 10/1963 | O'Connor, Jr. | 425/64 |
| 3,145,444 | 8/1964 | Brown et al. | 425/456 |
| 3,208,362 | 9/1965 | Sigmund | 425/64 |
| 3,452,406 | 7/1969 | Morgan | 425/456 |
| 3,477,354 | 11/1969 | Rink | 404/105 |

*Primary Examiner*—Ronald J. Shore
*Assistant Examiner*—John McQuade
*Attorney, Agent, or Firm*—Olson, Trexler, Wolters, Bushnell & Fosse, Ltd.

[57] ABSTRACT

The embodiment of the invention disclosed herein is directed to a curber and sidewalk-forming apparatus for contouring concrete along a predetermined run. The apparatus includes a hopper having at least one wall thereof sloping downwardly toward an opening formed in the bottom of the hopper which coincides with an opening formed in a slide plate surface at the bottom of the machine. Flowable concrete passes from the hopper through the opening in the slide plate and is directed rearwardly of the apparatus while the apparatus is transported in a predetermined direction along its run. A vibrating apparatus is secured to one of the walls of the hopper to insure proper flow of the concrete along the interior surface of the hopper so that the concrete continuously flows beneath the apparatus for forming curbs, gutters and sidewalks. A motor generator set is secured to the slide plate and produces electricity to operate electrical motors of the vibrator and winch secured thereto.

14 Claims, 12 Drawing Figures

ADJUSTABLE CURBER AND SIDEWALK-FORMING MACHINE

REFERENCE TO RELATED APPLICATION

This application is a continuation-in-part of copending application Ser. No. 480,844, filed June 19, 1974, now abandoned.

BACKGROUND OF THE INVENTION

The embodiment of the invention disclosed herein is directed to concrete handling apparatus, and more particularly to apparatus for forming contoured configurations such as curbs, gutters, sidewalks, and the like. More specifically, the invention is directed to concrete handling and forming apparatus which insures continuous smooth flow of concrete through a hopper to the underside of the apparatus whereupon a contoured slide surface continuously forms the desired concrete configuration as the apparatus moves along a predetermined run. A large variety of curb and gutter widths and shapes can be formed with ease by a single machine.

Heretofore, concrete handling machines have been provided to substantially increase the amount of concrete that can be handled over a given period of time. Some machines have been used to form roadways and the like. Other mechanisms have been offered, with greater or lesser success, for forming smaller jobs such as curbs, gutters and sidewalks.

One prior art approach to forming continuous lengths of poured concrete is to have a machine pulled over previously poured concrete to form the concrete to the desired configuration. This required the use of cement-mixing trucks or other means for supplying concrete in front of the machine. Because of the general unevenness of poured concrete from cement-mixing trucks, prior art machines also utilize leveling apparatus which extends along their width. This leveling apparatus increases the complexity and expense of the concrete handling machine. Furthermore, it increases substantially the weight of the machine to make it impractical for small jobs such as forming curbs, gutters and sidewalks.

Another approach to forming continuous, seamless lengths of concrete involves the use of a machine which travels over formers defining the sides of the poured concrete. Bulk concrete is introduced into a hopper, is poured, and is shaped into a final configuration by a rigid mold. However, some six thousand configuration of curbs and gutters are presently known, and some of these are required by various state and local governments. Whether required by the customer's fancy, the job's physical demands or the law's demands, a competitive contractor must be able to provide a wide variety of curb and gutter shapes and sizes.

Accordingly, it is an object of this invention to provide a new and improved concrete handling and forming machine which is efficient and reliable in operation and relatively simple and inexpensive to manufacture.

Another object of this invention is to provide a novel concrete handling and forming machine which is, in and of itself, relatively light in weight to facilitate transport from job to job.

Still another object of this invention is to provide a concrete handling and forming machine wherein pourable concrete is delivered to a hopper and the machine insures continuous flow of concrete from the hopper to the area beneath the machine whereupon the concrete is formed and finished.

Yet another object of this invention is to provide a concrete handling and forming machine which simultaneously pours and forms a curb and gutter configuration as it is transported along its run.

A further object is to provide a machine which can be quickly and easily altered or modified to form any of a great variety of curb and gutter or sidewalk shapes and widths. A related object is to provide such a machine which can be altered or modified by even inexperienced personnel in a relatively short time without the use of complex tools and the like.

Briefly, the curber and sidewalk-forming machine of this invention includes a hopper which has downwardly sloping walls converging at an opening through which the concrete flows. The concrete is gathered beneath the machine and takes a contour corresponding to a slide plate configuration which is at the bottom of the machine. Most advantageously, one of the sloping walls of the hopper is provided with two vibrators to shake the flowable concrete to insure uniform flow during the forming operation. The entire machine is pulled by a self-contained winch which, in turn, is operated by an electrical generator driven by a gas motor. The generator is mounted on 3 inches by 1 inch steel springs which are mounted on rubber grommets to insure that no vibration from the generator is passed on to the framework of the machine.

Many other objects, features and advantages of this invention will be more fully realized and understood from the following detailed description when taken in conjunction with the accompanying drawings wherein like reference numerals throughout the various views of the drawings are intended to designate similar elements or components.

DETAILED DESCRIPTION OF THE ILLUSTRATED EMBODIMENTS

Figure 1:
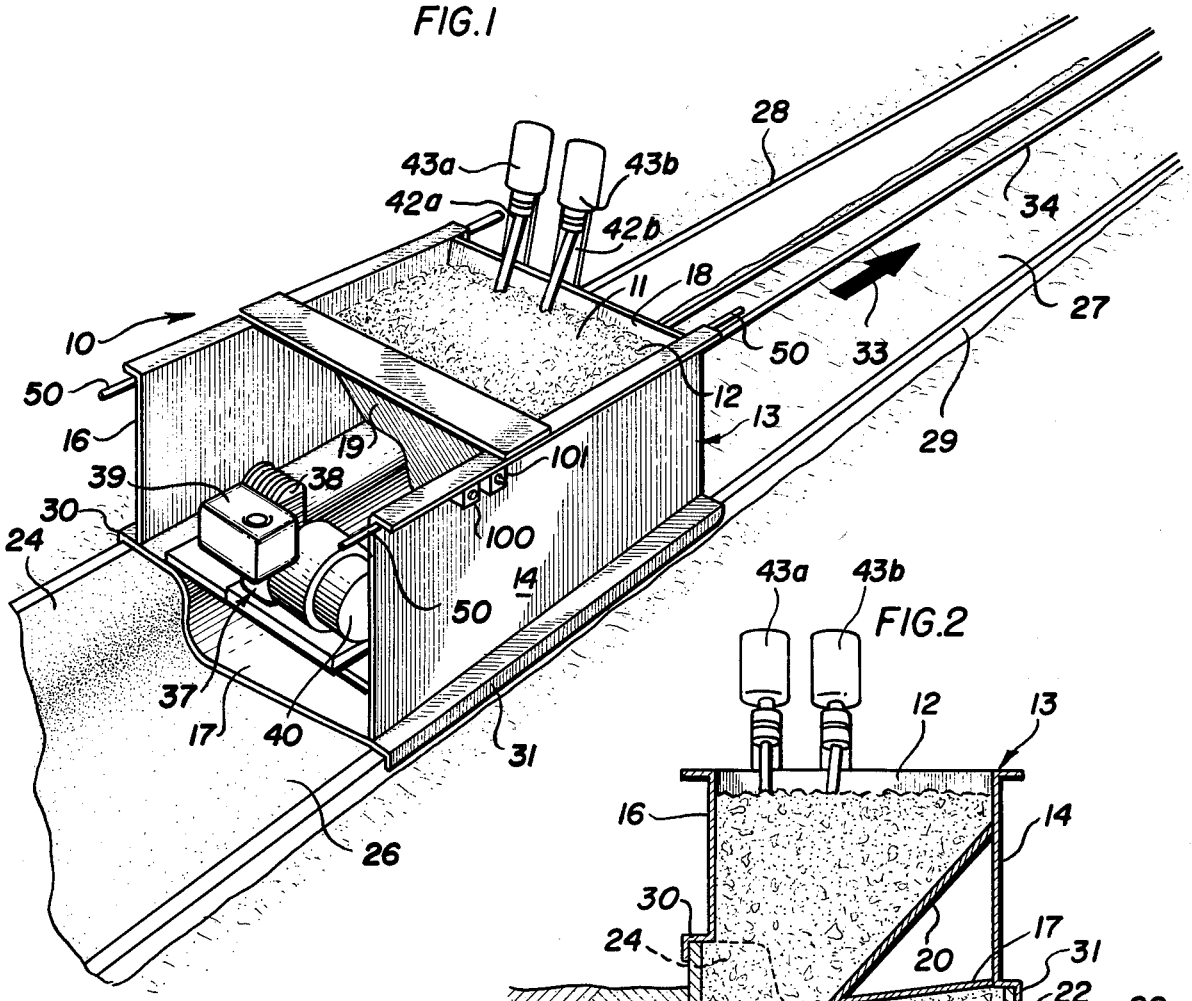
FIG. 1 is a perspective view of a curber and gutter-forming machine which is constructed in accordance with the principles of this invention.

Referring now to FIG. 1, there is seen a curb and gutter-forming machine constructed in accordance with this invention and designated generally by reference numeral 10. Concrete 11 can be poured from a cement-mixing truck or by other suitable means (not shown) into a machine hopper 12. The consistency of the concrete may provide what is termed in the art as a 2 inches slump; it can be watered or otherwise prepared as desired to suit the particular job.

Figure 2:
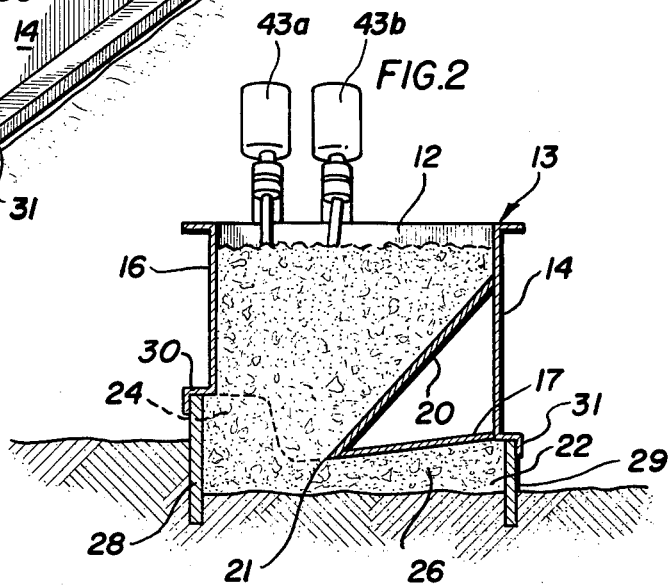
FIG. 2 is an end sectional view of the curber machine of FIG. 1.

The curb and gutter-forming machine 10 includes a frame structure 13 having a pair of upstanding side walls 14 and 16 extending upwardly from a slide plate member 17. The upstanding side walls 14 and 16 cooperate with sloping front and rear walls 18 and 19, respectively, to define the hopper 12. Preferably the hopper 12 has sloping front and rear walls and a sloping interior wall 20, as best seen in FIG. 2.

The slide plate member 17 has an opening 21 formed immediately adjacent to the bottom of the hopper 12 through which the flowable concrete passes to form a contour of wet concrete designated generally by reference numeral 22 beneath the apparatus. The slide plate 17 has the bottom surface thereof contoured to simultaneously form a curb portion 24 and a gutter portion 26.

Here, the slide plate surface 17 extends in front and back of the aperture 21 through which concrete flows. This arrangement insures proper contour of the concrete as the machine moves forward along its run.

To form the curb and gutter, a trench 27 is formed along a run and is defined by spaced-apart form members 28 and 29. The form members 28 and 29 provide rails to receive flange elements 30 and 31 of the frame member 13. These flange elements ride along the form while the curb and gutter-forming machine 10 is traversed in the direction as indicated by the arrowed line 33.

An electrically operated winch is positioned adjacent the front wall 18 of the hopper 12 and is connected to a cable 34. Preferably, the cable 34 is one-quarter inch steel cable 350' in length so that when it is doubled back upon itself it will pull the curb and gutter-forming machine 10 a total of 175 feet in a single run. A stationary pulley may be secured by any suitable means at the end of the run, such as by a pipe staked into the ground or by connecting it to a heavy vehicle positioned at the end of the run. The winch is operated by a motor generator set 37 located at the rear portion of the slide plate 17. The motor generator set includes a gasoline-driven engine 38 and a gas tank 39 to rotate a generator 40. The electrical power produced by the electrical generator 40 can be used to operate other suitable electrical apparatus.

Most advantageously, the concrete machine of this invention uses two vibrators during the formation of the curb and gutter to insure continuous downward flow of concrete through the hopper toward the opening 21. This is accomplished by securing a pair of upstanding rails 42*a* and 42*b* to the front wall 18 and securing vibrating mechanisms 43*a* and 43*b* to the rails. In the illustrated embodiment the vibrating mechanism may comprise two WYCO three-quarter horsepower electric motor vibrators. These vibrators will sufficiently agitate the concrete to allow the heavy concrete mix to flow downwardly. Any vibration from the vibrators 43*a* and 43*b* is absorbed by the mounting structure of the vibrators so that the walls of the machine do not absorb any of the vibration.

The frequency of the vibrations imparted to the concrete by the vibrators can be adjusted through a range to provide a rodding action of maximum effectiveness. To further enhance the effectiveness of this vibratory or rodding action, each vibrator can be adjusted independently of the other. This independent adjustment feature is particularly advantageous when one vibrator 43*a* is operating upon the concrete which will form the relatively high or thick curb and the other vibrator 43*b* is operating upon the relatively low or thin concrete which will form the gutter.

Figure 3:
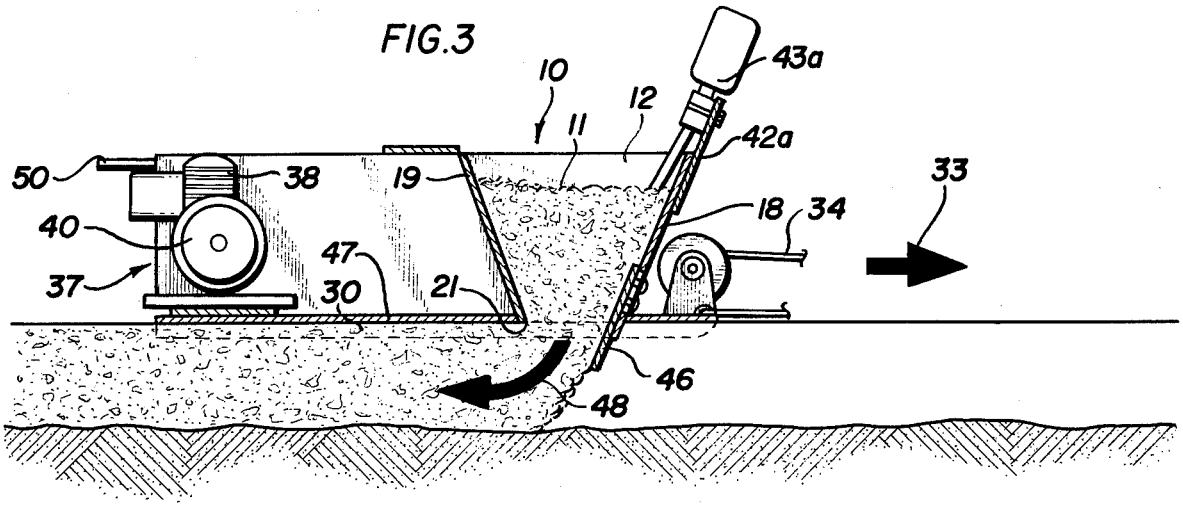
FIG. 3 is a side sectional view of the equivalent machine of FIG. 1.

As seen in FIG. 3, the hopper 12 has an adjustable baffle element 46 secured to the front wall 18 so as to prevent forward flow of slumping concrete as the curbing machine 10 moves in the direction of the arrowed line 33. Therefore, concrete will flow substantially beneath a forming scraper 47 formed on the rear wall 19 of the hopper as indicated by the curved arrowed line 48.

To facilitate handling of the curber and gutter-forming machine of FIGS. 1, 2 and 3, handle elements 50 may be located at the four corners thereof to enable workmen to pick up the machine when empty of concrete and place it on a transport trailer or truck when not in use.

Figure 4:
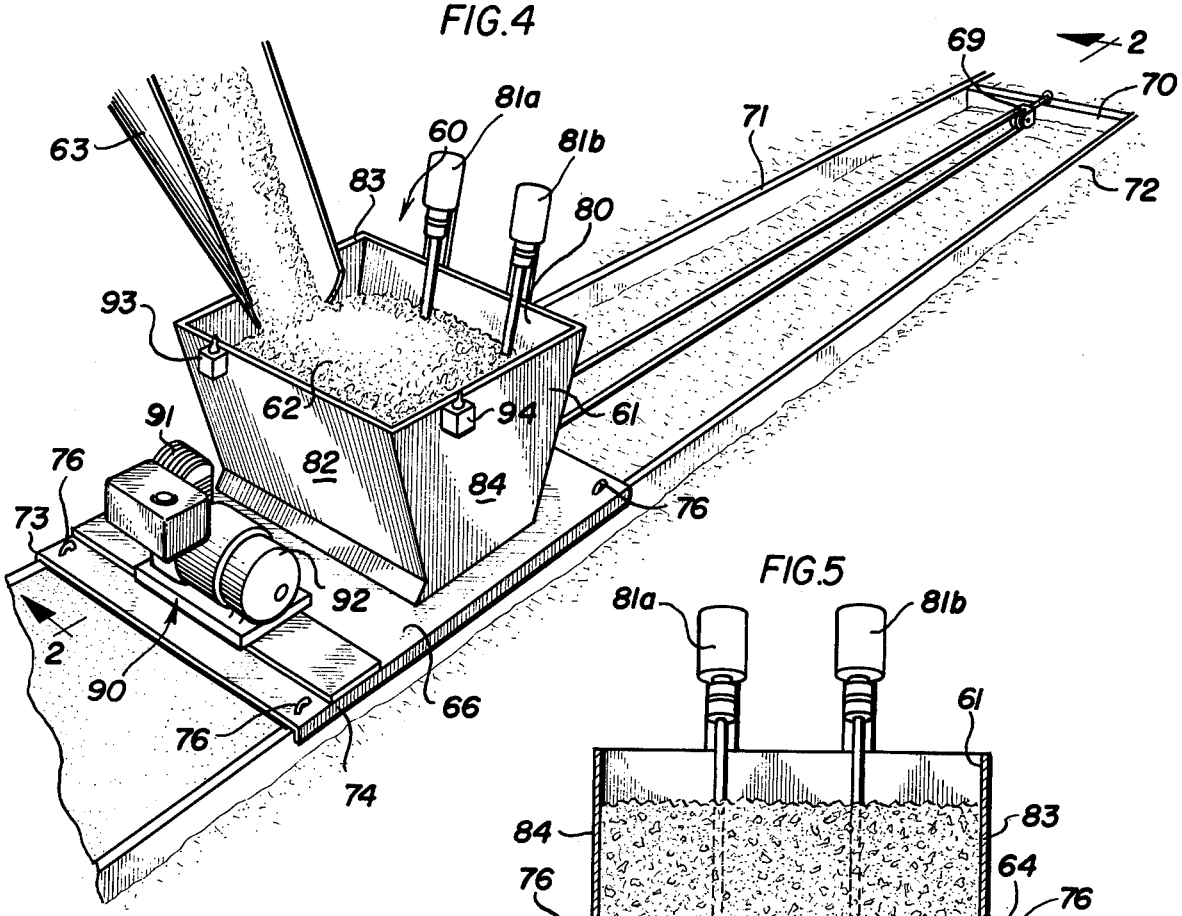
FIG. 4 is a perspective view of a sidewalk-forming machine constructed in accordance with the principles of this invention.
Figure 5:
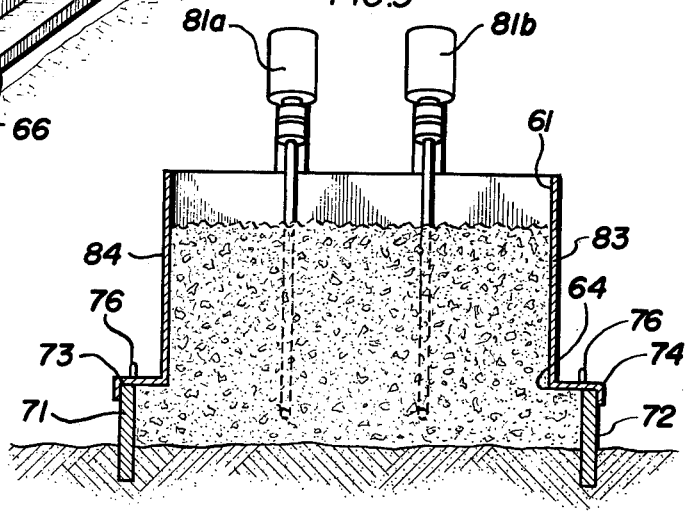
FIG. 5 is an end sectional view of the sidewalk-forming machine of FIG. 4.
Figure 6:
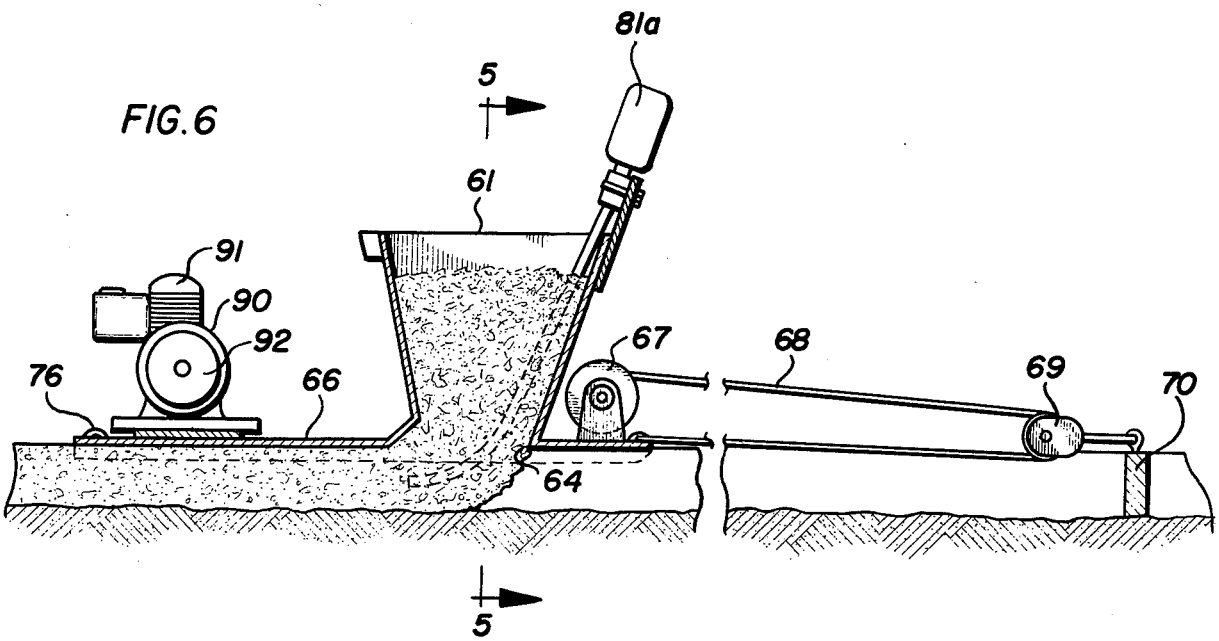
FIG. 6 is a side sectional view of the sidewalk-forming machine of FIG. 4.

Referring now to FIGS. 4, 5 and 6, there is seen a sidewalk-forming machine constructed in accordance with the principles of this invention and designated generally by reference numeral 60. Here the sidewalk machine 60 includes a hopper 61 to receive a quantity of flowable cement 62 from a trough 63 of the cement-mixing and delivery truck, as is well known in the art. The cement within the hopper 61 flows along sloping walls to an opening 64 at the bottom of the hopper so that flowable concrete passes beneath a slide plate 66 immediately behind the hopper. Secured to the slide plate 66, in front of the hopper 61, is an electrically operated winch 67 which has a cable 68 secured thereto. The cable 68 passes through a pulley 69 which, in turn, is secured to a crossbrace 70 between spaced-apart formers 71 and 72. The formers 71 and 72 also act as guide rails for downwardly-turned flanges 73 and 74 formed on the slide plate 66, as best seen in FIG. 1. In this instance, movement of the sidewalk-forming machine is accomplished by hook members 76 is located at the four corners thereof to facilitate receiving chain units to be lifted by a crane or the like.

The hopper 61 has a front wall 80 arranged to receive a pair of vibrators 81*a* and 81*b* which can operate substantially in the same manner as set forth with regard to the curb and gutter-forming machine 10 of FIG. 1. The rear wall 82 of the hopper also slopes downwardly while spaced-apart side walls 83 and 84 are substantially vertical. The electrically operated vibrators 81*a* and 81*b* together with the electrically operated winch 67 are energized by a gasoline-driven motor generator set 90 having a gas engine 91 and a generator 92 connected thereto. Suitable control boxes 93 and 94 are located at convenient locations about the periphery of the hopper to enable workmen to control the various functions of the sidewalk-making machine as it moves along its run.

Referring once again to FIG. 1, control boxes 100 and 101 are located adjacent to side wall 14 to enable workmen to control the various functions, for example, the turning on and off of the winch and vibrator.

Figure 8:
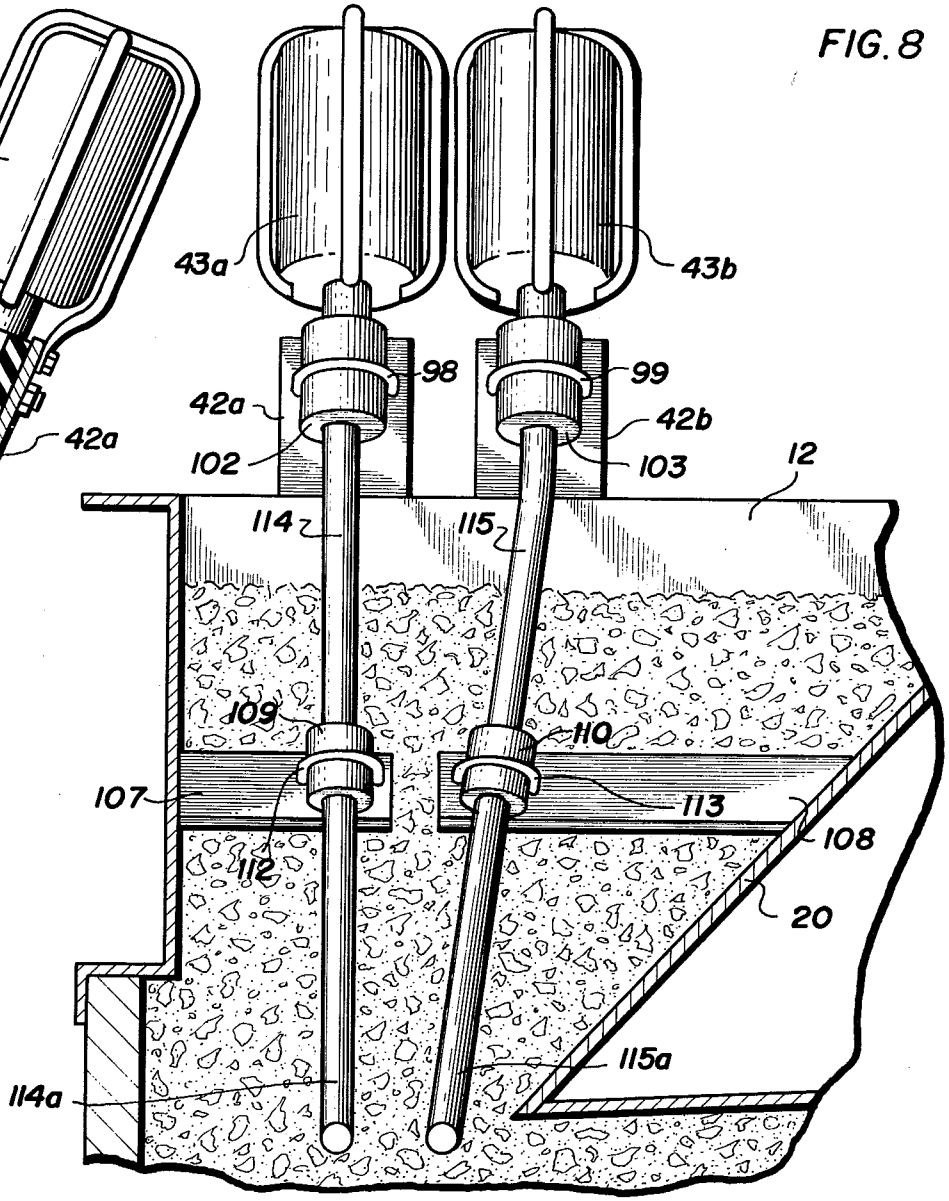
FIG. 8 is a front sectional view showing further details of construction of the vibrator arrangement of this invention.
Figure 7:
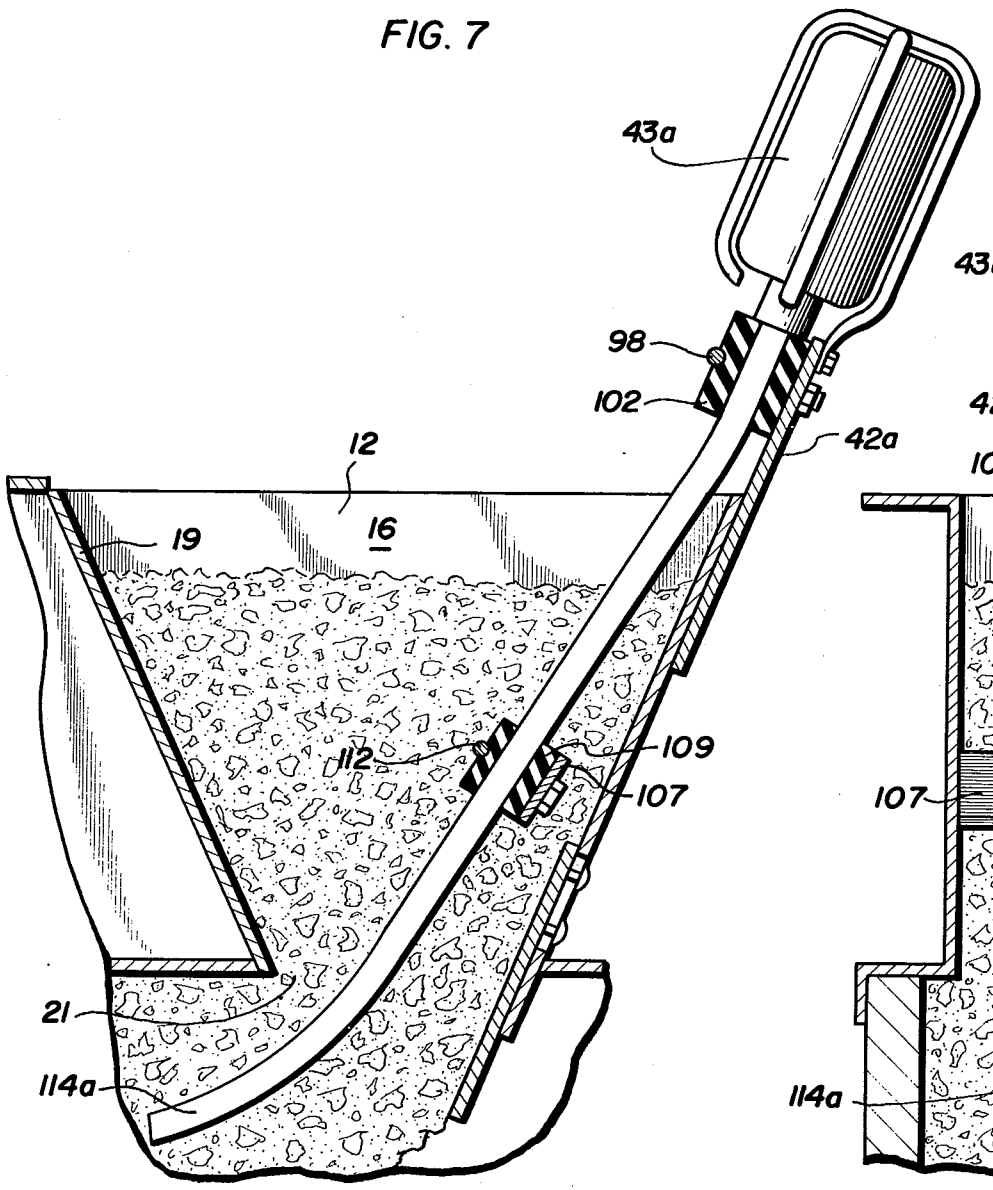
FIG. 7 is a side sectional view showing the details of construction of the vibrator used to insure proper flow of the concrete.
Figure 9:
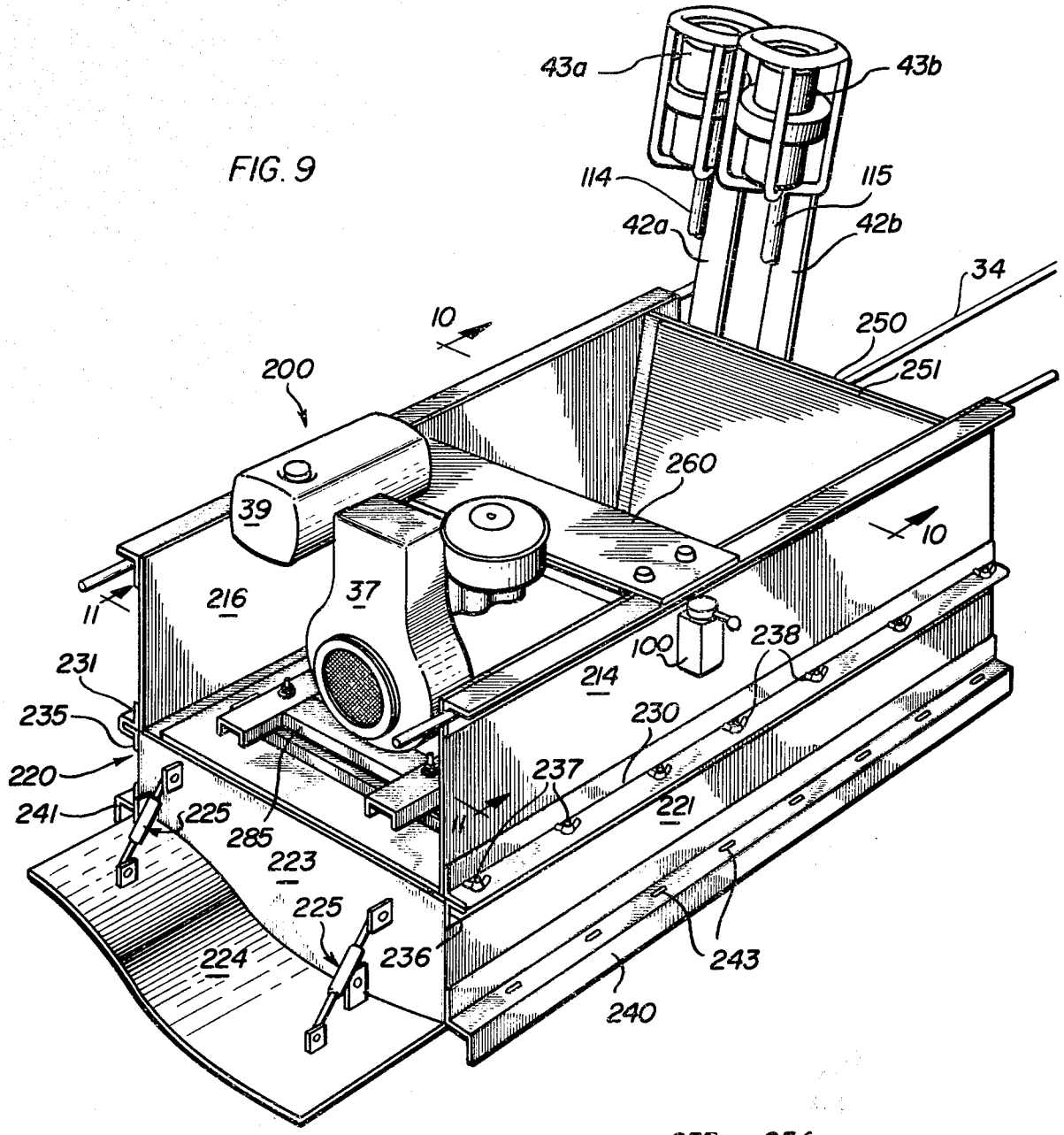
FIG. 9 is a perspective view of another embodiment of the curb forming machine.
Figure 10:
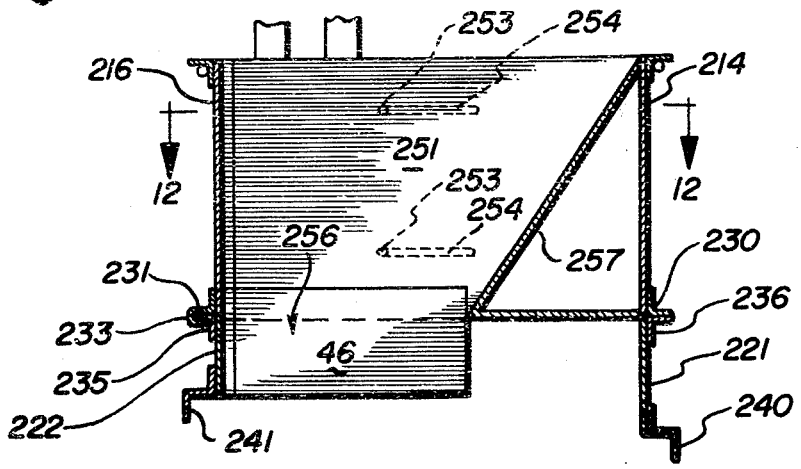
FIG. 10 is a sectional view of the machine shown in FIG. 9 taken substantially in the plane of line 10—10 in FIG. 9.
Figure 11:
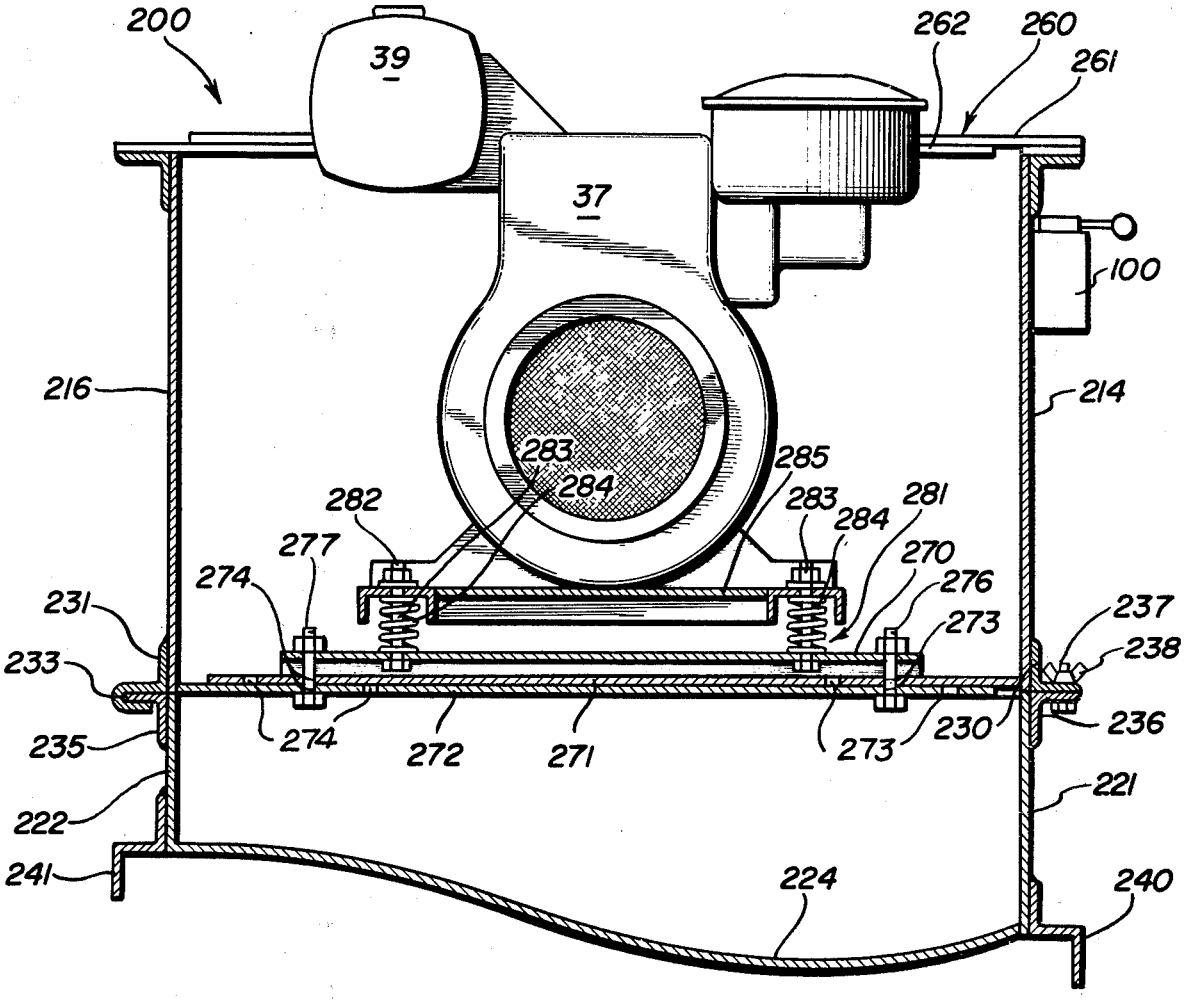
FIG. 11 is a sectional view of the machine shown in FIG. 9 taken substantially in the plane of line 11—11 in FIG. 9.

Referring now to FIGS. 7 and 8, the details of construction of the vibrating arrangement of this invention are more clearly illustrated. Here, the pair of vibrators 43*a* and 43*b* are shown secured to their respective brackets 42*a* and 42*b* by suitable cushioning means to prevent the vibration of the machine, but which will substantially vibrate the concrete to insure proper flow thereof. The upper portion of each of the vibrators is secured to its bracket by a U-clamp 98 and 99 which is wrapped about a rubber bushing or grommet 102 and 103, respectively. The rubber bushings 102 and 103 may be formed from a short length of rubber hose material or the like. Secured within the hopper 12 are mounting brackets 107 and 108 which also provide means for receiving rubber grommets 109 and 110, respectively. The grommets 109 and 110 are held to the brackets 107 and 108 by U-bolts 112 and 113.

By so mounting the vibrators 43*a* and 43*b* a minimum amount of vibration is transmitted through the structure of the curbing machine while substantial amounts of vibration or rodding action are subjected to the flowable concrete by vibrating rods 114 and 115 associated with the vibrators 43*a* and 43*b*, respectively. The vibrating rods 114 and 115 extend into the flowable concrete and may have a curved end portion 114*a* and 115*a* to facilitate in agitating the concrete. While one single specific type of vibrator is illustrated herein, it will be understood that other suitable concrete vibrating means may be provided without departing from the spirit and scope of the novel concepts of this invention.

By utilizing the vibrator arrangement as set forth hereinabove the sidewalk and curber machines disclosed herein provide improved reliability and life of the associated equipment, such as the motor-generator set and winch associated therewith. The vibrations applied to the concrete are substantially dampened and no external vibrations applied to these components.

Yet another embodiment of the machine is shown in FIGS. 9–12, inclusive. It will be understood that this embodiment (of FIGS. 9–12) can be equipped with the winch and cable 34 and/or baffle plate 46 shown in FIGS. 1, 3, 4, 6 and 7 in conventional manner without departing from the spirit and scope of the invention. In accordance with the invention, a wide variety of curb and gutter formations and widths can be poured, formed and finished by this machine. To this end, the machine 200 includes side walls 214 and 216, and a removable mold structure 220 at the machine bottom. Here, this mold structure 200 includes mold side plates 221 and 222, an end plate 223 between the side plates, and an end finishing skirt 224 which can be affixed to the end plate 222 as by turnbuckle struts 225. These turnbuckle struts 225 can be appropriately manipulated to adjust the position of the skirt 224 with respect to the rest of the mold 220.

It is a feature of the invention that this mold 220 can be quickly detached from the machine side rails 214 and 216 and another mold of differing configuration substituted in its place. To this end, the machine side-defining side rails 214 and 216 are each provided with flanges 230 and 231. To reduce cost, these flanges 230 and 231 can be formed of angle iron stock or other convenient material. One flange 231 is provided with an extended foot which is reversely bent into a slot-defining formation 233. A mating angle-iron flange 235 is positioned, as by welding, upon the mold side plate 222 to fit within this slot 233 and to secure one edge of the mold to that machine side frame.

On the opposite machine side, the flange 230 is secured by welding or other convenient means. A mating flange 236 is secured to the mold side 221. Bolts 237 are slipped through registering holes in these flanges 230 and 236; security is provided by wing nuts 238. When it is desired to change one mold for another, the wing nuts can be quickly and easily turned off by even inexperienced personnel, and the bolts 237 are removed from the flanges. Thereafter, the mold can be quickly slipped from the slot 233 on the opposite machine side and another mold inserted in its place. When the holes in the new mold flange 236 are registered with the holes in the frame, the bolts 237 can be replaced and the wing nuts 238 reapplied to secure this new mold in position.

It is a feature of the invention that this machine does not ride up or float upon grout expelled by rodding from the poured cement and forming curb and gutter. To this end, the mold is provided with Z-shaped rail flanges 240 and 241 on lower opposite sides of the mold 220. To permit the grout to bleed from underneath the mold without forcing the machine to ride excessively high over the forming cement, and forms 71 and 72 a series of slots or holes 243 are formed in each rail flange 240 and 241.

Figure 12:
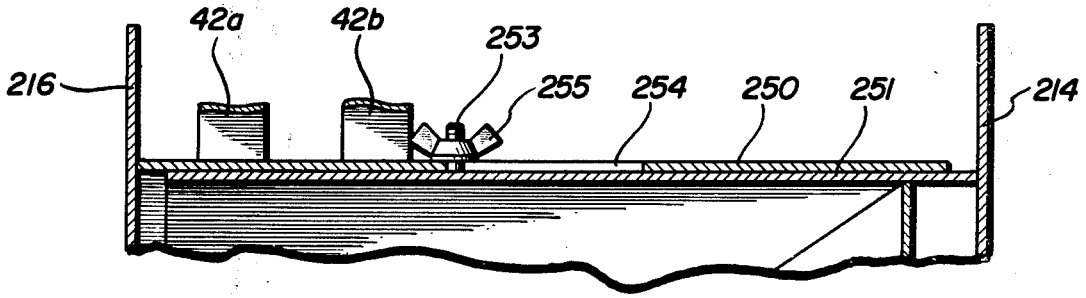
FIG. 12 is a sectional view taken substantially in the plane of line 12—12 in FIG. 10.

It is a feature of this invention that the effective width of this machine can be easily and quickly adjusted. For example, a mold 222 having an effective width of 16 inches can be removed, the machine effectively widened, and a mold having an effective width of 20 inches can be installed. To this end, the apparatus includes two interconnected sides, and that machine structure which defines the front and rear of the hopper, a top brace, a floor plate, and the engine mounts are mounted upon dual sliding surfaces. More particularly, the hopper front is here defined by two diagonally oriented, substantially superimposed plates 250 and 251 extending from the respective side frames 214 and 216. As shown in FIG. 12, a bolt 253 can be welded or otherwise attached to one of these plates 251 and protrudes through a slot 254 in the opposite plate 250; to draw the plate 251 toward the plate 250 in a snug cement-tight fit, a wing nut 255 is provided. When it is desired to increase the effective width of the machine, this wing nut 255 is simply loosened and the side frame 214 is drawn away from the side frame 216. When the desired effective width of the machine is obtained, this wing nut 255 can be retightened to increase the structural machine rigidity. Similar structure is provided for the opposite side of the cement hopper.

It is to be noted that the concrete-dropping hopper bottom opening 256 is defined entirely on that half or side of the machine upon which the relatively raised curb is being contoured. This permits the pouring concrete to flow downwardly and outwardly during curb and gutter formation, and allows increased apparatus structural rigidity. To this end, a diagonally disposed hopper side-defining plate 257 is carried on one machine side or shown in FIG. 10.

To yet further enhance machine rigidity, a top frame piece 260 here comprises two overlapping plates 261 and 262. Through bolts secure these two plates 261 and 262 together in a rigid support.

To reduce manufacturing costs and improve the speed and ease with which the effective width of the machine can be altered, combined floor plate securing and motor mounting structure is provided. Here, this structure takes the form of channel irons 270 which are adapted to be laid over a top floor plate 271. Other floor structure is defined by an underlying floor plate 272. Passing through aligned slots 273 and 274 in these floor plates and the channel iron 270 are connecting bolts 276 and 277. The channel iron 270 provides head clearance for resilient motor mounts 281 and 282 which comprise headed bolts 283 whose shanks are surrounded by coil springs 284. Resting on these coil springs 284 is a rigid platform (here formed of channel irons 285) to which the generator set 37 itself is mounted. When it is desired to adjust the effective width of the machine, these bolts 276 and 277 can be loosened, the machine effective width altered, and the bolts reinserted through aligned floor plate holes.

I claim:

1. Adjustable apparatus for forming contoured concrete as the apparatus travels along forms defining a run, comprising, in combination, first and second machine sides adjustable toward and away from one another and together defining a hopper having at least one wall inclined from a large upper concrete receiving opening to a small lower concretedropping opening and a platform comprising a plurality of floor plates, each plate affixed to a machine side and together mounting motive power means, attachment means on each machine side, for attaching a mold to each machine side, and a detachable mold of fixed width selected from a series of detachable molds of differing fixed configurations and widths, the mold being fitted to the attachment means of both machine sides when the machine sides are located at a predetermined distance from one another, and rail means carried on the mold for guiding the apparatus along run-defining forms.

2. The apparatus for forming contoured concrete as set forth in claim 1 and including vibrator means having an electric motor mounted on said hopper, and a transport means including an electric winch secured to the machine sides, and to which is secured a stationary pulley along said run, and wherein an engine driven generator set is secured to the floor plates, the generator set being capable of generating electricity to operate the electric motor of said vibrator means and the electric winch of said transport means.

3. The apparatus for forming contoured concrete as set forth in claim 1 including a motor generator set secured to said floor plates rearwardly of said hopper with respect to the direction of travel of said apparatus.

4. The apparatus for forming contoured concrete as set forth in claim 1 including a winch secured to said machine sides in front of said hopper with respect to the direction of travel thereof and cable means extending from said winch to engage a stationary pulley secured a predetermined distance from the machine sides along said run whereby said winch will pull the cable and cause the apparatus to move along said run.

5. The apparatus for forming contoured concrete as set forth in claim 1 further including rearwardly and downwardly extending baffle plate means positioned within said hopper to direct the flow of cement from the hopper through the lower opening in said hopper so that the concrete flows rearwardly with respect to the direction of travel and under a contour-forming surface provided by said hopper lower opening.

6. The apparatus for forming contoured concrete as set forth in claim 5 wherein said baffle plate means is of fixed width and includes interconnector means interconnecting the hopper and the baffle plate means for adjusting the location of the baffle plate means along the front wall surface of the hopper so as to provide control of the amount of forward flow of flowable concrete when the concrete passes through the hopper lower opening.

7. Adjustable apparatus according to claim 1, wherein said attachment means for attaching the mold to each machine side includes a reversely turned, slot-defining first side flange on one machine side and a second side flange defining a plurality of bolt-accepting holes on the opposite machine side, and wherein said mold includes an end plate for forming the concrete dropped from the hopper into a finished contour, side plates affixed to each side of the end plate, a first mold flange carried on one mold side plate and having an outwardly extending ledge shaped for insertion in the first side flange slot whereby to secure one mold side plate to one machine side, and a second mold flange carried on the opposite mold side plate and having an outwardly extending ledge defining a plurality of bolt-accepting holes arrayed for registry with the second side flange bolt-accepting holes, the apparatus further including bolt means inserted through the bolt-accepting holes of the flanges to secure the second machine side to the mold, whereby the two machine sides and the mold are interattached in a rigid concrete pouring and forming unit.

8. Adjustable apparatus according to claim 1 wherein both machine sides are provided with a hopper side-defining means and a projecting, diagonally disposed hopper end-defining plate adapted to superimpositionally mate with the projecting hopper end-defining plate of the other machine side, the hopper end-defining plates and hopper side-defining means together defining the concrete-receiving hopper.

9. Adjustable apparatus according to claim 8 wherein the hopper side-defining means carried on one machine side slopes diagonally from said large upper receiving opening to said small dropping opening, the small concrete dropping opening thereby being defined entirely on one offset half of the apparatus.

10. Adjustable apparatus according to claim 9 wherein the mold includes a mold end plate shaped to form a relatively raised curb and a relatively depressed gutter, and wherein said hopper is so disposed as to define said small concrete-dropping opening entirely on that side of the mold plate where the raised curb is formed.

11. Adjustable apparatus according to claim 1 including means mounted on and in the hopper for rodding the concrete carried in the hopper, said rail means depending from the mold for guiding the mold on run-defining forms, each rail means defining a series of bleed holes disposed to permit grout rodded from the interior mass of the concrete being poured to flow through the holes and away from the apparatus, thereby permitting the rail means to rest securely upon the forms.

12. Adjustable apparatus according to claim 16 wherein said rail means includes Z-shaped flanges secured to the bottom of said mold.

13. Adjustable apparatus for forming contoured concrete as the apparatus travels over a base course and along forms defining a run; comprising, in combination, first and second machine sides adjustable toward and away from one another and together defining a hopper having at least one wall inclined from a large upper opening for receiving plastic concrete to a small lower concrete-dropping opening, and a detachable mold of fixed width fitted to both machine sides when the machine sides are located at a predetermined distance from one another, means on the mold and the machine sides attaching the mold to each machine side, and a baffle plate of fixed width extending downwardly and rearwardly from a front hopper wall and terminating above the base course so as to limit forward flow of the plastic concrete and maintain internal pressure within the plastic concrete for forming and maintaining elevated portions of the concrete contour.

14. Adjustable apparatus according to claim 13 wherein said hopper is at least partly defined by front and rear walls, each front and rear wall being defined by a plurality of substantially superimposed plates extending from said machine sides, and means extending between the plates for drawing the plates toward one another to increase structural machine rigidity during machine use.

* * * * *

UNITED STATES PATENT AND TRADEMARK OFFICE

CERTIFICATE OF CORRECTION

PATENT NO. : 4,027,990

DATED : June 7, 1977

INVENTOR(S) : Charles T. Merrill

It is certified that error appears in the above-identified patent and that said Letters Patent are hereby corrected as shown below:

Column 4, line 38, "beneth" should be --beneath--;

Column 4, line 49, after "76" delete --is--;

Column 5, line 51, "200" should be --220--;

Column 8, line 61, "claim 16" should be --claim 11--

Signed and Sealed this

*Twentieth* Day of *September 1977*

[SEAL]

*Attest:*

RUTH C. MASON
*Attesting Officer*

LUTRELLE F. PARKER
*Acting Commissioner of Patents and Trademarks*